US011447997B2

(12) United States Patent
Bortoluzzi et al.

(10) Patent No.: US 11,447,997 B2
(45) **Date of Patent: *Sep. 20, 2022**

(54) DAMPING OR RETURN DEVICE FOR SLIDING DOOR LEAVES OR FOR DRAWERS

(71) Applicant: BORTOLUZZI SISTEMI S.P.A., Belluno (IT)

(72) Inventors: Guido Bortoluzzi, Belluno (IT); Adriano Girotto, Spresiano (IT)

(73) Assignee: BORTOLUZZI SISTEMI S.P.A., Belluno (IT)

( * ) Notice: Subject to any disclaimer, the term of this patent is extended or adjusted under 35 U.S.C. 154(b) by 0 days.

This patent is subject to a terminal disclaimer.

(21) Appl. No.: 15/528,912

(22) PCT Filed: Nov. 18, 2015

(86) PCT No.: PCT/EP2015/077017

§ 371 (c)(1),
(2) Date: May 23, 2017

(87) PCT Pub. No.: WO2016/083217

PCT Pub. Date: Jun. 2, 2016

(65) Prior Publication Data

US 2017/0321466 A1 Nov. 9, 2017

(30) Foreign Application Priority Data

Nov. 24, 2014 (IT) ..... MI2014U000368

(51) Int. Cl.
*E05F 5/00* (2017.01)
*E05D 15/06* (2006.01)

(52) U.S. Cl.
CPC ..... *E05F 5/003* (2013.01); *E05D 15/063* (2013.01); *E05Y 2201/46* (2013.01); *E05Y 2900/132* (2013.01); *E05Y 2900/20* (2013.01)

(58) Field of Classification Search
CPC ..... E05Y 2900/132; E05Y 2900/20; E05Y 2201/46; E05F 5/003; E05D 15/063
(Continued)

(56) References Cited

U.S. PATENT DOCUMENTS 3,346,993 A * 10/1967 Johnson ..... E05D 15/066 16/320
3,492,037 A * 1/1970 Hutchinson ..... E05C 19/165 292/251.5

(Continued)

FOREIGN PATENT DOCUMENTS

DE 3301808 A1 8/1983
EP 1658785 A1 5/2006

(Continued)

OTHER PUBLICATIONS

K&J Magnetics, All About Magnetization Direction, www.kjmagnetics.com (Year: 2019).*

(Continued)

*Primary Examiner* — Daniel J Troy
*Assistant Examiner* — Timothy M Ayres
(74) *Attorney, Agent, or Firm* — Brooks Kushman P.C.

(57) ABSTRACT

A damping or return device for sliding door leaves or drawers, particularly for furniture, is provided. The device has a first trolley, which is associated with a door leaf and is slideable with respect to an item of furniture, by a diametrically differently-polarized magnet, which is associated with the first trolley or with the item of furniture, and by at least one steel plate, which is associated with the item of furniture or with the first trolley. The first trolley interacts selectively with at least one elastically compressible element which abuts, in opening and in closing, with an abutment element which is associated with and protrudes from the item of furniture.

14 Claims, 5 Drawing Sheets

(58) Field of Classification Search
USPC ..... 312/334.6
See application file for complete search history.

(56) References Cited

U.S. PATENT DOCUMENTS

| | | | | |
|---|---|---|---|---|
| 6,167,589 | B1 * | 1/2001 | Luedtke | E05F 1/00 16/49 |
| 7,308,975 | B2 * | 12/2007 | Nehl | B60G 17/01933 188/267 |
| 8,910,345 | B2 * | 12/2014 | Bland | E05F 1/00 16/71 |
| 9,457,635 | B2 * | 10/2016 | Pepka | F16F 6/005 |
| 9,752,367 | B2 * | 9/2017 | Girotto | E05D 15/0652 |
| 10,246,923 | B2 * | 4/2019 | Bortoluzzi | E05F 5/003 |
| 10,392,848 | B2 * | 8/2019 | Bortoluzzi | E05F 5/02 |
| 2009/0090587 | A1 * | 4/2009 | Tomita | F16F 9/065 188/282.6 |
| 2011/0126476 | A1 | 6/2011 | Bertram | |
| 2016/0090770 | A1 * | 3/2016 | Girotto | E05D 15/0652 312/319.1 |
| 2017/0321464 | A1 * | 11/2017 | Bortoluzzi | E05F 5/003 |
| 2017/0321465 | A1 * | 11/2017 | Bortoluzzi | E05F 5/003 |

FOREIGN PATENT DOCUMENTS

| | | | |
|---|---|---|---|
| EP | 2455571 | A1 | 7/2010 |
| EP | 2330269 | A2 | 11/2010 |
| EP | 2557259 | A2 | 2/2013 |
| IT | 0000277022 | | 9/2013 |
| JP | S49-045400 | Y | 4/1974 |
| JP | S58-131281 | Y | 8/1983 |
| JP | 2003-056247 | A | 2/2003 |
| JP | 2005-048554 | A | 2/2005 |
| JP | 2007182714 | A | 7/2007 |
| JP | 2011-062416 | A | 3/2011 |
| JP | 2012-504537 | A | 2/2012 |
| NL | 1034479 | C2 | 4/2009 |
| WO | 2014/108729 | A1 | 11/2014 |
| WO | 2016075050 | A1 | 5/2016 |
| WO | 2016075051 | A1 | 5/2016 |

OTHER PUBLICATIONS

K&J Magnetics, Magnetization Direction, www.kjmagnetics.com (Year: 2019).*

Magnet-shop, Information about the magnetization direction, www.magnet-shop.com (Year: 2019).*

Stanford magnets, Magnetization Direction for Neodymium Magnets, www.stanfordmagnets.com (Year: 2019).*

Written Opinion and Search Report of International Application No. PCT/EP2015/077017; dated Feb. 5, 2016; 9 pages.

Japanese Patent Application No. 2017-527760 Office Action dated Dec. 3, 2019, 8 pages.

* cited by examiner

DAMPING OR RETURN DEVICE FOR SLIDING DOOR LEAVES OR FOR DRAWERS

CROSS-REFERENCE TO RELATED APPLICATIONS

This application is the U.S. national phase of PCT Application No. PCT/EP2015/077017 filed on Nov. 18, 2015, which claims priority to Italian Patent Application No. MI2014U000368 filed on Nov. 24, 2014, the disclosures of which are incorporated in their entirety by reference herein.

TECHNICAL FILED

The present invention relates to a damping or return device for sliding door leaves, of the type with co-planar closure or otherwise, particularly for furniture and the like, or for drawers.

BACKGROUND

Nowadays as an alternative to usual, hinged doors, solutions are known for sliding doors that can be applied both to wardrobes and pieces of furniture in general, and also to door and window frames or to any other application of closing elements that require a reduced space when open.

Usually such types of door are constituted by one or more door leaves, each one of which has brackets with rolling means that are guided by a rail, which is constituted by an upper guide and by a lower guide, which respectively are applied to the ceiling and optionally to the floor of the compartment to be closed.

It is known to fit the door leaf with a device to return it to the open position, which can be disengaged as needed when it is desired to close the sliding door, or to the closed position, when it is desired that the door leaf follow a guided closure.

A problem that is found in conventional sliding door leaves is constituted by the fact that the door leaf can remain partially closed or partially open or it can slam, on the jambs of the door or on the sides of the item of furniture, when the door leaf is completely opened or completely closed.

Similar observations can be made for drawers.

A partial solution to such drawback is known from EP 1658785 which discloses a device that is adapted to assist and guide the movement of a door leaf, which comprises a receptacle inside which is placed a damper, a spring, and an entrainment element that can be accommodated within a pair of teeth that are associated with a coupling element which comprises a guiding pin that can slide into an upturned L-shaped guide.

The device is arranged proximate to one end of the compartment.

For example, when opening the door leaf, at a certain point the device hooks the entrainment element that activates the damper until the pin is positioned, through the L-shaped guide, in a stable and stationary condition: when the door leaf is closed, the entrainment element interacts with the pair of teeth and activates the damper which thus gently accompanies the door up until the condition where it is completely closed.

Such solution however suffers some drawbacks: the device is in fact complex in terms of construction in that it is constituted by a plurality of elements that have to be put together in advance while paying great attention to the elements of play that exist for example between the L-shaped guide and the pin that rests in it, since any sticking or the creation of friction could defeat the operation of the device and thus prevent the correct closing or complete opening of the door leaf.

Furthermore, conventional return devices suffer other criticalities which are linked to the fact that the return spring does not have a constant force along its stroke.

This causes problems with the return along the final part of the stroke because the force is low and there are, inversely, problems with opening the door in the final part when the door is released, where the force of the spring is too high.

This, combined with the fact that the connection to the return mechanism of the door in motion occurs by way of mechanical means, creates bothersome noise in operation.

EP 2455571 is also known, which discloses a mechanism for forcible movement which comprises a first urging body to apply a force toward a certain position for a fixed body in a standby position.

A striker body is captured at a prescribed position by the fixed body which is held in standby position, and a movable body is moved up to a position at end of movement by way of the relative movement of the fixed body to the determined position by the release of the hold on the occasion of the capture.

A damping mechanism comprises a contact part for connection with the fixed body constituting the mechanism for forcible movement, a second body urging the contact part in an advancement direction.

The damping mechanism is constituted so as to apply a resistance to a retraction of the contact part accompanying the movement of the fixed body to the determined position.

Such solution also suffers the same drawbacks mentioned previously.

EP 2557259 is also known, which discloses to a braking device that comprises pneumatic braking means which can be activated by way of a slider interacting with a fixed frame, for example of the door, in one embodiment there is a piston the rod of which is provided, at the end tip, with a magnetic head the function of which is, once it has come into contact with a fixed L-shaped profile with one wing positioned head-on to the magnetic head, to allow the rod to be extracted from the stem of the piston.

Such solution suffers many drawbacks such as the considerable length required for the braking device, the stem of which is subject to possible breakage or sticking; furthermore, the reliability of the pneumatic functionality is poor.

Finally the sole function of the magnetic head is to directly couple to a fixed body, arranged along the same axis, for the extraction of the stem.

EP 2330269 is also known, which discloses to a sliding guide for doors of wardrobes which has a damper stop comprising a trolley consisting of a first frame and a second frame shaped like an upturned "U" to which the upper ends of an outer or inner door are fixed.

The damper stop comprises an air or gas damper fixed outside two seats which are provided on a section associated with the trolley.

Such solution also suffers many drawbacks, such as the use of a gas damper which, moreover, is arranged laterally to the trolley so as to increase the space taken up and render the guide barely usable.

Also known is an Italian patent for a utility model no. 277022, which discloses a damping or return device for sliding door leaves, particularly for furniture, which is characterized in that it is constituted by at least one shock absorber, which is coupled proximate to one end of the item of furniture adjacent to a side thereof, and which has magnetic means for temporary interconnection with a slider, which is associated with the door leaf and has a support provided with a magnetic axial guide, the slider being C-shaped and between its wings, which can slide across the magnetic axial guide, there being magnets with opposing polarities which also oppose the magnetic axial guide.

Although such solution is functional, the use of the slider and of the guide is complex in terms of construction and is therefore expensive in terms both of manufacture and of assembly.

SUMMARY

The aim of the present invention is therefore to resolve the above mentioned technical problems, by eliminating the drawbacks in the cited known art and hence providing a device, which can be applied to sliding doors or door leaves or for drawers, which has a simple structure, which enables a rapid and easy assembly thereof, which is free from sticking and which makes it possible to obtain the optimal closing and opening of the door or of the door leaf, while preventing the same from slamming against the wall of the item of furniture.

Within this aim, another object of the invention is to provide a device that is easily applied to conventional door leaves or to conventional doors of furniture.

Another object of the invention is to provide a device by which it is possible to contain the friction and elements of play in the various movements, thereby optimizing the movement and the sliding of the door leaf.

Another object is to provide a device that is free from bothersome noises during its operation.

This aim and these and other objects which will become better apparent hereinafter, are achieved by a damping or return device for sliding door leaves, particularly for furniture or for drawers, which is characterized in that it is constituted by:

- a first trolley, which is associated with said door leaf and is slideable with respect to said item of furniture,
- a diametrically differently-polarized magnet, associated with said first trolley or with said item of furniture,
- at least one steel plate, associated with said item of furniture or with said first trolley, said first trolley interacting selectively with at least one elastically compressible element which abuts, in opening and in closing, with an abutment element which is associated with and protrudes from said item of furniture.

BRIEF DESCRIPTION OF THE DRAWINGS

Further characteristics and advantages of the invention will become better apparent from the detailed description of a particular, but not exclusive, embodiment, which is illustrated by way of non-limiting example in the accompanying drawings wherein.

DETAILED DESCRIPTION

Figure 1:
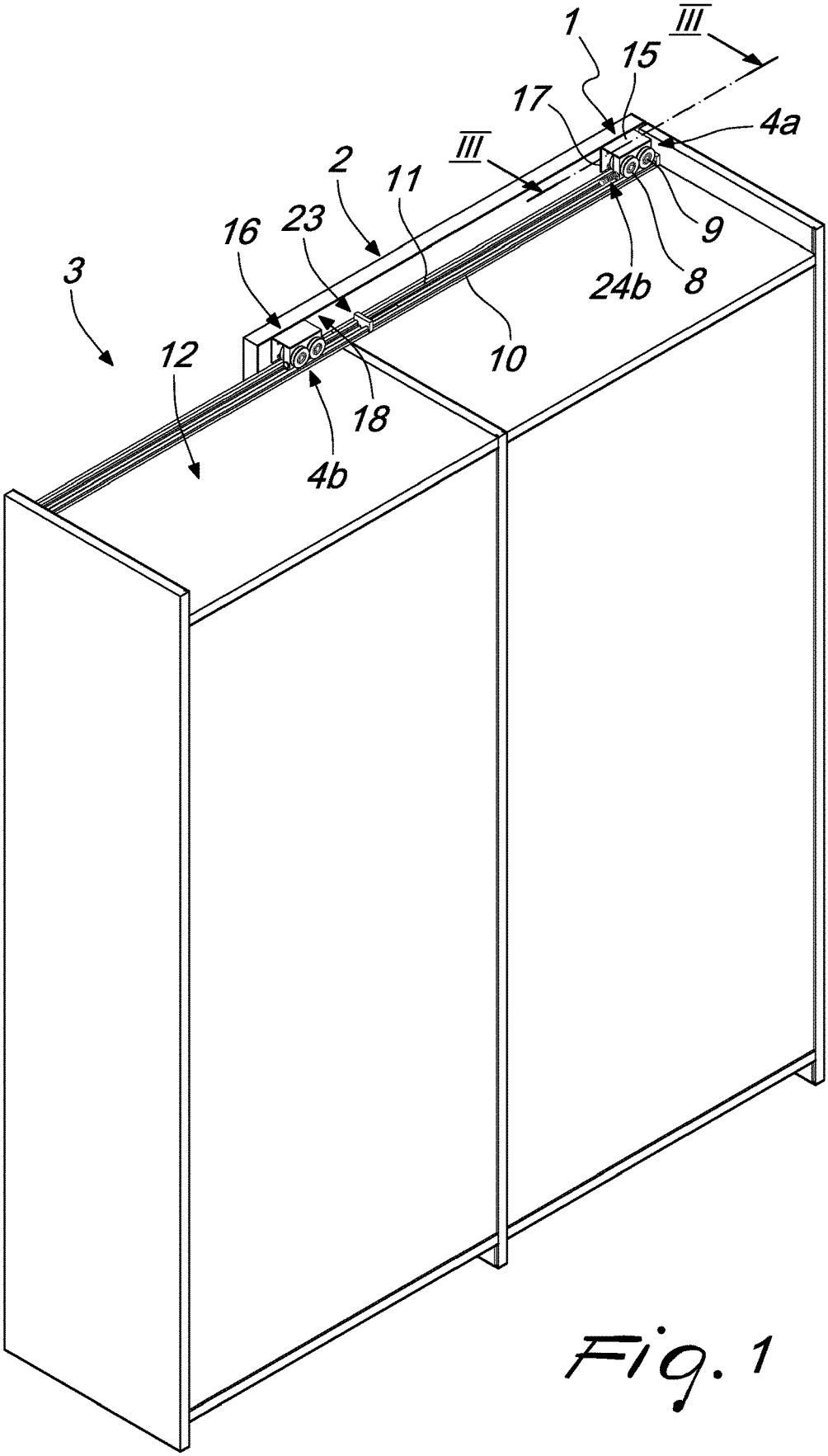
FIG. 1 is a perspective view of a device applied to an item of furniture with the door leaf closed.
Figure 2:
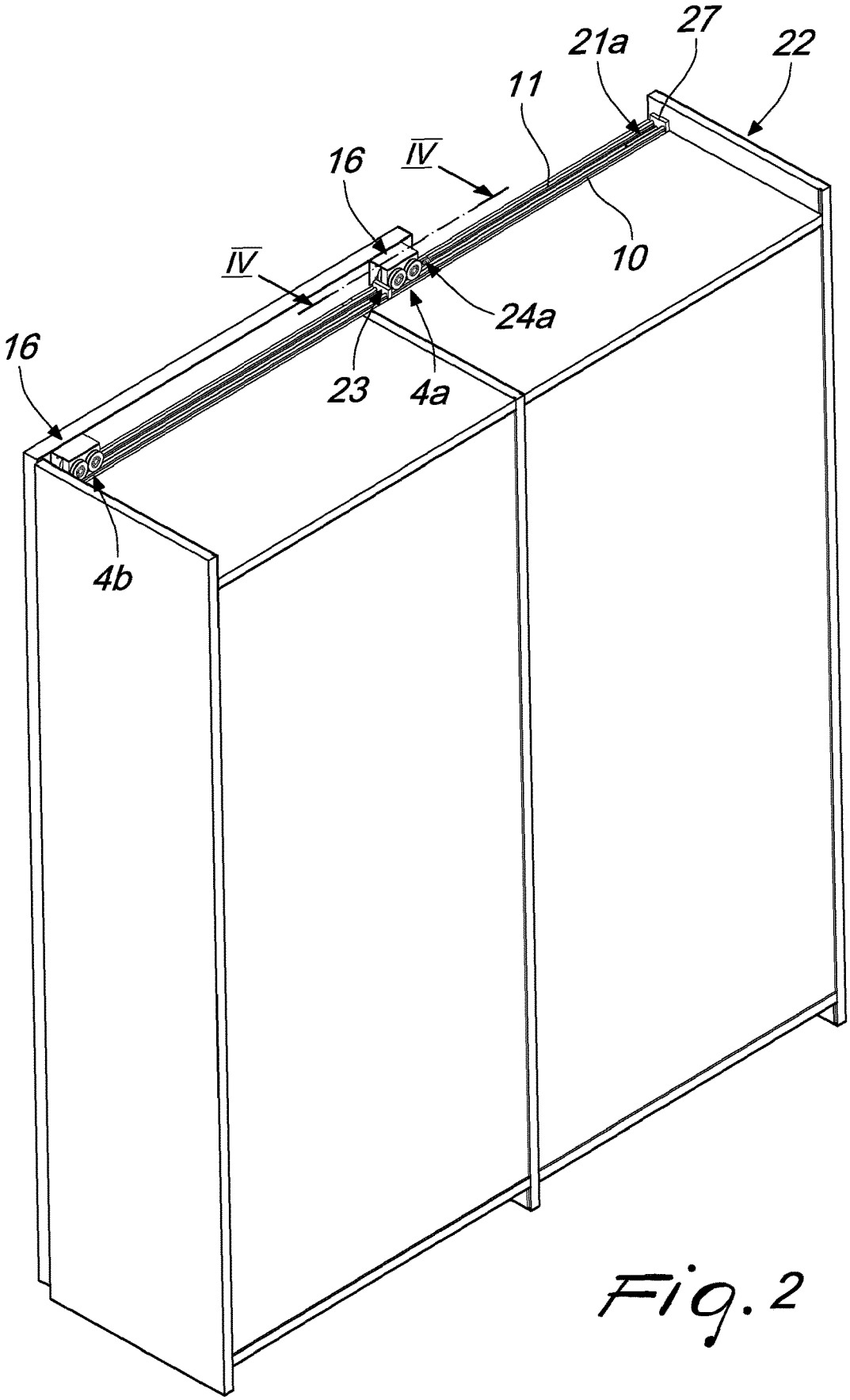
FIG. 2 is a perspective view of the device applied to an item of furniture with the door leaf open.
Figure 3:
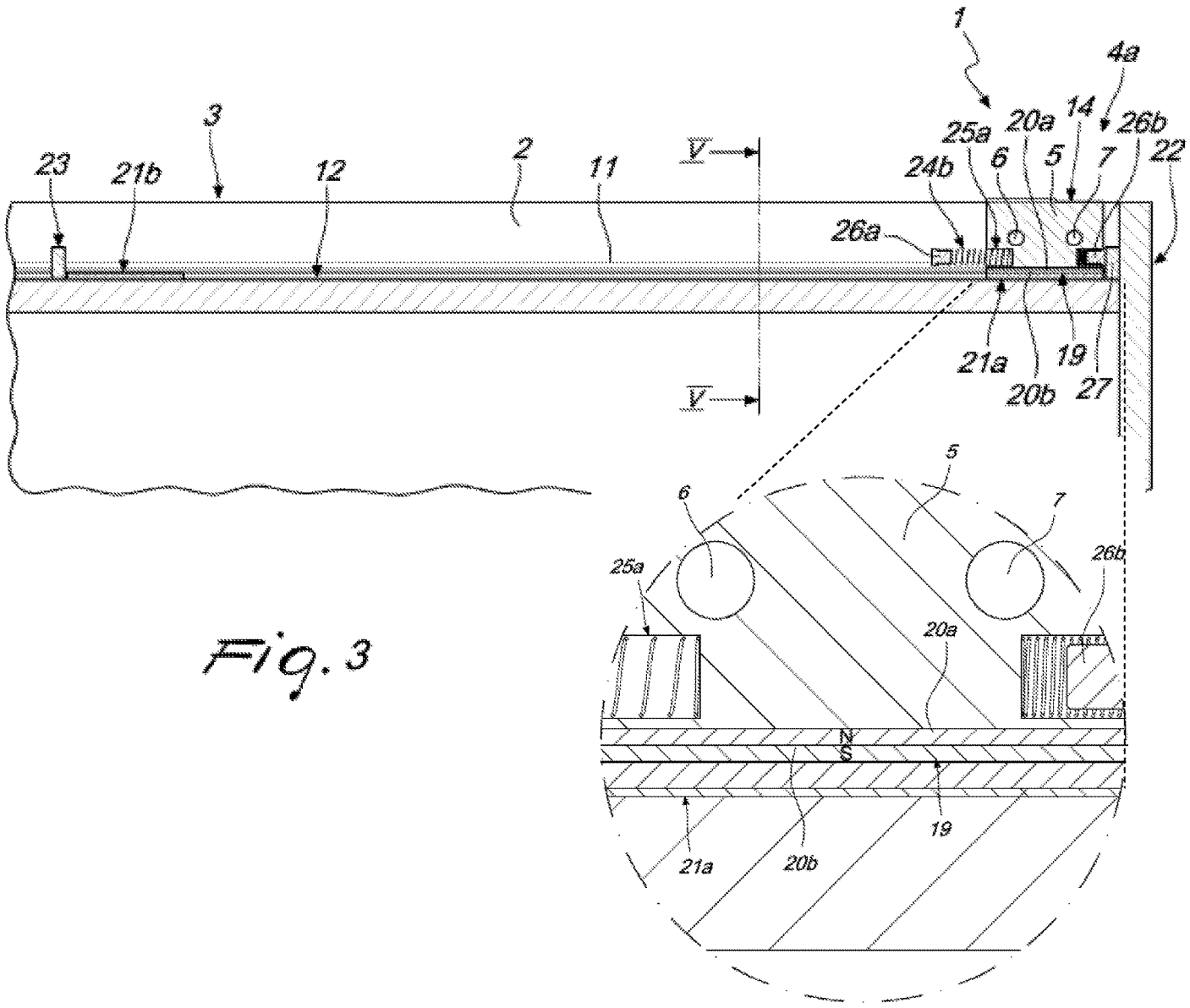
FIG. 3 is a cross-sectional view taken along the line ill-III in FIG. 1.
Figure 4:
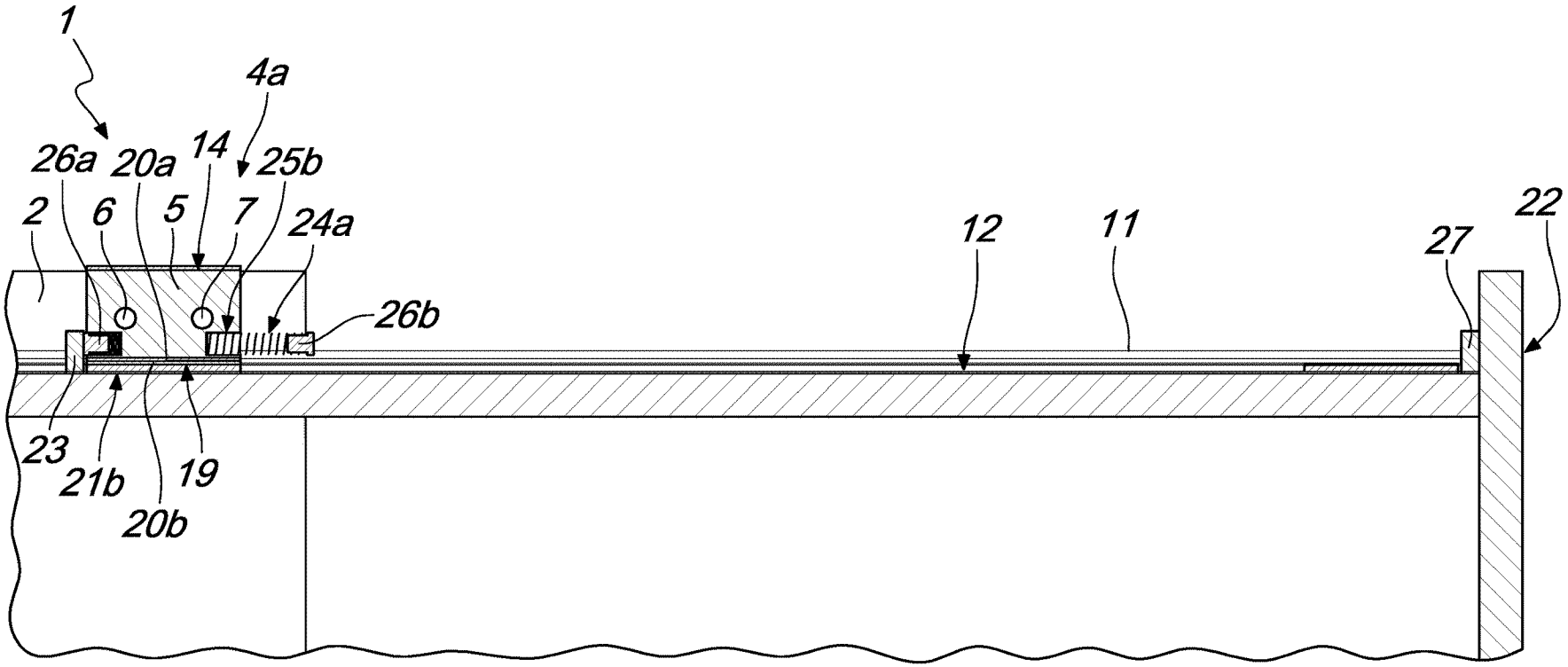
FIG. 4 is a cross-sectional view taken along the line IV-IV in FIG. 2.
Figure 5:
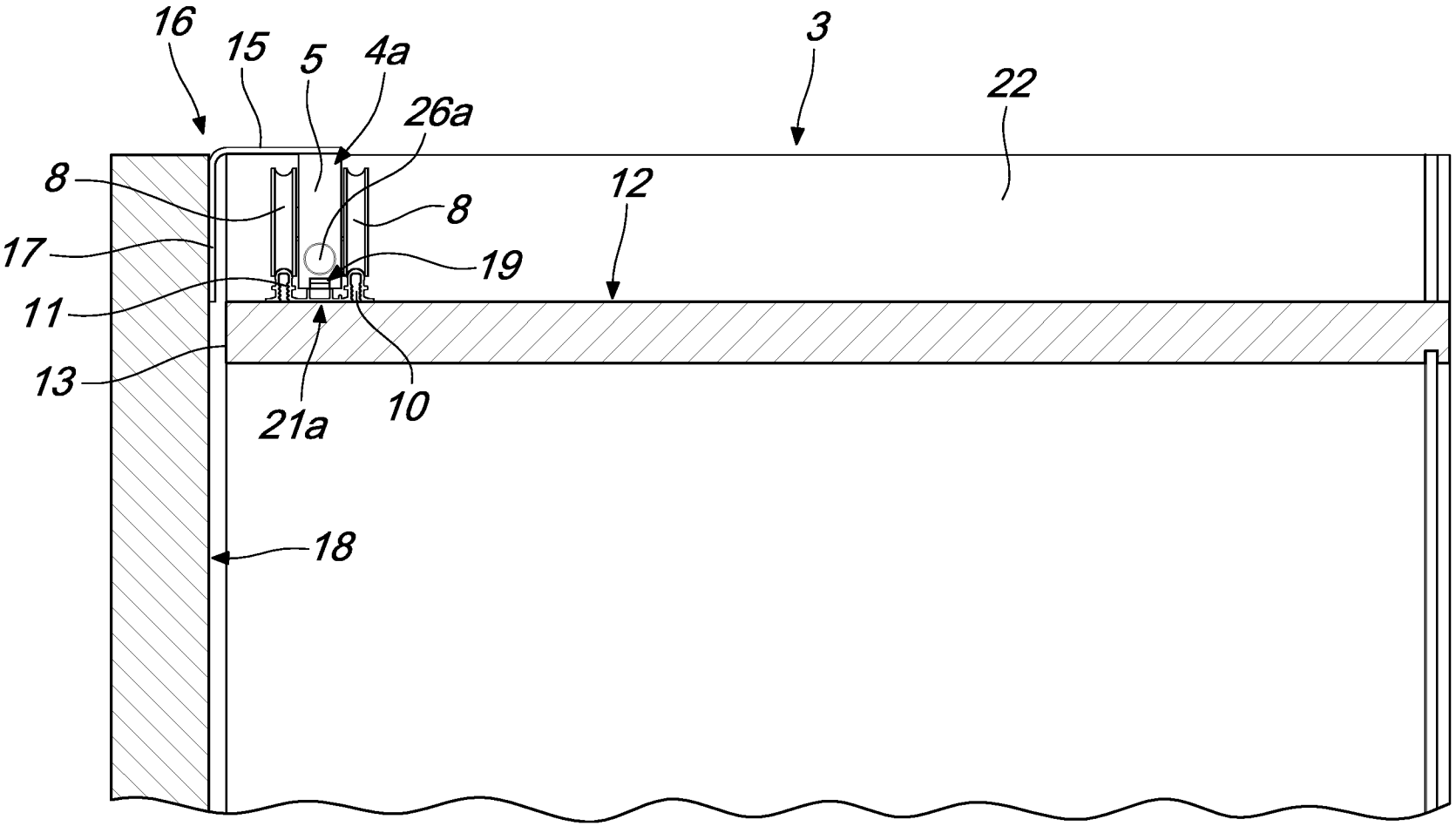
FIG. 5 is a cross-sectional view taken along the line V-V in FIG. 3.

In the embodiments illustrated, individual characteristics shown in relation to specific examples may in reality be interchanged with other, different characteristics, existing in other embodiments.

Moreover, it should be noted that anything found to be already known during the patenting process is understood not to be claimed and to be the subject of a disclaimer.

With reference to the figures, the reference numeral 1 generally designates a damping or return device for sliding door leaves 2, particularly of the type associated with furniture 3 and the like, or for drawers (not shown). For example, the door leaf 2 may form a side panel of a drawer.

The device 1 comprises a first trolley 4*a* which is constituted by a central body 5, substantially parallelepiped in shape, with which two pins 6, 7 are transversely associated, which are arranged mutually parallel proximate to the ends of the central body, and which are rotatably associated with two pairs of wheels 8, 9, which are idle.

The wheels slide on adapted guides or rails 10, 11 which are associated with and protrude from the top 12 of the item of furniture 3 proximate to the perimetric edge 13 thereof adjacent to the door leaf 2.

The first trolley 4*a* is arranged, with the door leaf closed, proximate to a first lateral end of the door leaf 2.

At the upper surface 14 of the central body 5 a first wing 15 of an L-shaped plate 16 is associated therewith, the second wing 17 of which is associated with the facing internal lateral surface 18 of the door leaf 2.

There is a second carriage 4*b*, which is similar to the previous one and arranged proximate to a second lateral end of the door leaf 2.

The door leaf 2 is therefore supported by and can slide with respect to the item of furniture 3.

At the longitudinal central plane of the central body 5 of the first trolley 4*a*, a magnet 19 is associated therewith which is diametrically polarized differently; it is therefore, from the magnetic point of view, divided into a first half-magnet 20*a* and a second half-magnet 20*b*, which are coupled together and are mutually identical, are polygonal, preferably rectangular, in cross-section, and have opposing polarities.

For example the first half-magnet 20*a* has a north polarity N and the second half-magnet 20*b* has a south polarity S.

The device is further constituted by two steel plates 21*a*, 21*b*, which are associated, at the top 12 of the item of furniture 3 at a central region, with the guides or rails 10, 11 so as to be in axial alignment with the diametrically differently-polarized magnet 19.

One of the two plates 21*a*, 21*b* is arranged proximate to a lateral wall 22 of the item of furniture 3 and the other proximate to a first abutment element 23 which protrudes from the top 12 in an area that corresponds to the condition in which the door leaf is open.

The plates 21 have a length substantially equal to that of the diametrically differently-polarized magnet 19.

As an alternative to using the two plates 21*a*, 21*b*, as a technically equivalent solution, a further magnet can be used with polarities which may or may not be opposite to that of the magnet 19.

The first trolley 4*a* interacts selectively with a pair of elastically compressible elements 24*a*, 24*b* which abut, in opening and in closing, respectively with the lateral wall 22 of the item of furniture 3 and with the first abutment element 23.

Each one of the elastically compressible elements 24*a*, 24*b* is constituted by a spring that lies partially within a seat 25*a*, 25*b* which is provided axially to the central body 5 in a region that lies above the diametrically differently-polarized magnet 19.

The free ends of each one of the elastically compressible elements 24*a*, 24*b* protruding externally from the central body 5 are associated with a plug 26*a*, 26*b* which abuts with the first abutment element 23 or with the lateral wall 22 of the item of furniture 3 or with a second abutment element 27 arranged against the lateral wall 22.

In operation, in the final stage of opening or closing a door leaf, with which the diametrically differently-polarized magnet 19 is associated, the elastically compressible elements 24*a*, 24*b* come to interact with the lateral wall 22 of the item of furniture 3 or with the first or second abutment element 23, 27 and furthermore the diametrically differently-polarized magnet 19 begins to affect, by overlapping, one of the steel plates 21*a*, 21*b*.

Thus a force is generated which contrasts the movement to open or close the door leaf thus making the movement gentle.

In practice it has been found that the invention has fully achieved the intended aim and objects, a device being obtained that can be applied to sliding doors or door leaves, including existing doors or door leaves, and is provided with a simple structure that, partly thanks to the use of the diametrically differently-polarized magnet 19, is free from sticking, thus making it possible to achieve the optimal and gentle closing and opening of the door or of the door leaf, while preventing the same from slamming on the wall of the piece of furniture.

Furthermore, the weight and dimensions and cost of the device are contained, while at the same time making it possible to contain the friction and elements of play in the various movements, so as to optimize the movement and the sliding of the door leaf or of the drawer.

Obviously protection is also requested for the version in which two diametrically differently-polarized magnets 19 are used, which are associated with the item of furniture 3 in the areas previously affected by the two plates 21*a*, 21*b*, and in which a single steel plate is used, which is associated with the first trolley 4*a*.

Obviously the materials used as well as the dimensions of the individual components of the invention may be more relevant according to specific requirements.

The various means of achieving certain different functions certainly need not coexist only in the embodiment shown, but may be present in many embodiments, even if they are not shown.

The characteristics indicated above as advantageous, convenient or the like, may also be missing or be substituted by equivalent characteristics.

The disclosures in Italian Utility Model Application No. MT2014U000368 (202014902311658) from which this application claims priority are incorporated herein by reference.

The invention claimed is:

1. A damping or return device for furniture comprising:

a first trolley configured to be attached to a door leaf of an item of furniture to slide the door leaf in a longitudinal direction during opening and closing, wherein the first trolley has a central body being substantially parallelepiped in shape, a magnet being polygonal in cross-section and formed of first and second portions having opposing polarities, the first portion coupled to and superimposed over the second portion in a polarity direction transverse to the longitudinal direction, the magnet attached to the first trolley, two planar steel plates spaced apart in the longitudinal direction and attached to the item of furniture or the first trolley and arranged parallel to the magnet, wherein one of the two planar steel plates is arranged proximate to a lateral wall of the item of furniture that corresponds to a closed condition of the door leaf, and the other of the planar steel plates is arranged proximate to a first abutment element which protrudes from a top in an area that corresponds to a condition in which the door leaf is open;

an abutment element configured to protrude from the item of furniture;

at least one elastically compressible element disposed on the first trolley, and arranged to damp movement in opening and in closing when the elastically compressible element abuts the abutment element; and a pair of elastically compressible elements, wherein one of the pair of elastically compressible elements abuts the lateral wall of the item of furniture in the closed condition and the other of the pair of elastically deformable elements abuts the abutment element in the open condition, wherein each of the elastically compressible elements comprises a spring positioned above the magnet.

2. The device according to claim 1, wherein the two planar plates have a length substantially equal to that of the magnet.

3. The device according to claim 1, wherein free ends of each one of the elastically compressible elements protruding externally from the central body.

4. The device according to claim 1, wherein the magnet is a single magnet.

5. A damping or return device for furniture comprising:

a first trolley configured to be connected to a door leaf and configured to slide in a longitudinal direction with respect to an item of furniture to move the door leaf in opening and closing;

a single magnet formed of first and second portions being generally planar and coupled opposite each other so each of the first and second portions have opposite polarities in a polarity direction transverse to the longitudinal direction, the magnet configured to be coupled to one of the first trolley or the item of furniture;

two planar steel plates positioned parallel to the magnet and configured to be coupled to the item of furniture or the first trolley, wherein one of the two planar steel plates is arranged proximate to a lateral wall of the item of furniture that corresponds to a closed condition of the door leaf, and the other of the planar steel plates is arranged proximate to a first abutment element in an area that corresponds to a condition in which the door leaf is open;

at least one abutment element configured to protrude from the item of furniture; and a pair of elastically compressible elements disposed on the first trolley and arranged to damp movement in opening and in closing when the elastically compressible element abuts the abutment element, wherein one of the pair of elastically compressible elements abuts the lateral wall of the item of furniture in the closed condition and the other of the pair of elastically deformable elements abuts the abutment element in the open condition, wherein each of the elastically compressible elements comprises a spring positioned above the magnet.

6. The device according to claim 5, wherein the first trolley comprises a central body and the magnet is coupled to the central body.

7. The device according to claim 5, wherein the first and second portions are coupled together to form a polygonal cross-section of the magnet.

8. The device according to claim 5, wherein the two plates have a length substantially equal to the magnet.

9. The device according to claim 5, wherein the two planar steel plates are spaced apart in the longitudinal direction and attached to the other of the item of furniture or the first trolley and arranged parallel to the magnet.

10. The device according to claim 5, wherein a free end of each of the elastically compressible elements protrudes externally from a central body of the first trolley.

11. The device according to claim 5, wherein the magnet is coupled to one of a fixed part or with a moveable part of the item of furniture and the at least one steel plate is coupled to the other of the moveable part or the fixed part of the item of furniture.

12. A damping or return device for furniture comprising:

a first trolley configured to be connected to a panel and configured to slide in a longitudinal direction with respect to an item of furniture to move the panel in between an open position and a closed position;

a magnet being generally planar and having a polarity direction transverse to the longitudinal direction, the magnet configured to be coupled to one of the first trolley or the panel of the item of furniture to slide in the longitudinal direction in opening and closing;

two planar steel plates positioned parallel to the magnet and configured to be coupled to the item of furniture or the first trolley, wherein one of the two planar steel plates is arranged proximate to a lateral wall of the item of furniture that corresponds to a closed condition of the door leaf, and the other of the planar steel plates is arranged proximate to a first abutment element in an area that corresponds to a condition in which the door leaf is open;

at least one abutment element configured to protrude from the item of furniture; and a pair of elastically compressible elements disposed on the first trolley and arranged to damp movement in opening and in closing when the elastically compressible element abuts the abutment element, wherein one of the pair of elastically compressible elements abuts the lateral wall of the item of furniture in the closed condition and the other of the pair of elastically deformable elements abuts the abutment element in the open condition, wherein each of the elastically compressible elements comprises a spring positioned above the magnet.

13. The device according to claim 12, wherein the magnet is a single magnet.

14. The device according to claim 12, wherein the at least one steel plate comprises two planar steel plates spaced apart in the longitudinal direction and attached to the other of the item of furniture or the first trolley and arranged parallel to the magnet.

* * * * *